United States Patent [19]

Gross

[11] Patent Number: 4,931,054

[45] Date of Patent: Jun. 5, 1990

[54] DEVICE FOR REMOVING HAIR

[75] Inventor: Joseph Gross, Moshav Mazor, Israel

[73] Assignee: Hair Remover, Ltd., Tel Aviv, Israel

[21] Appl. No.: 243,373

[22] Filed: Sep. 9, 1988

[51] Int. Cl.[5] ..... A61B 17/00

[52] U.S. Cl. ..... 606/43; 128/751; 128/755; 17/11.1 R; 17/47; 30/41.6; 464/181; 464/901

[58] Field of Search ..... 128/355, 749, 751, 755, 128/354; 17/11.1 R, 47; 30/41.6; 464/901, 184, 179, 181; 606/43, 210

[56] References Cited

U.S. PATENT DOCUMENTS

| | | | |
|---|---|---|---|
| Re. 30,680 | 7/1981 | Kress et al. | 464/901 X |
| 2,161,138 | 6/1939 | Cutting | 464/179 |
| 2,470,151 | 5/1949 | Digby | 17/11.1 R |
| 2,543,372 | 2/1951 | Mueller, Jr. | 17/11.1 R |
| 3,638,455 | 2/1972 | Francois | 464/181 |
| 3,742,656 | 7/1973 | Amos | 464/901 X |
| 3,840,938 | 10/1974 | Carlson | 17/11.1 R |
| 4,054,127 | 10/1977 | Milan et al. | 128/757 |
| 4,524,772 | 6/1985 | Daar et al. | 128/355 |
| 4,726,375 | 2/1988 | Gross et al. | 128/355 |
| 4,799,293 | 1/1989 | Dewberry et al. | 17/11.1 R |
| 4,807,624 | 2/1989 | Gross et al. | 128/355 |

*Primary Examiner*—Richard J. Apley
*Assistant Examiner*—J. L. Doyle
*Attorney, Agent, or Firm*—Benjamin J. Barish

[57] ABSTRACT

A depilatory device for removing body hair comprises a manually-grippable housing and a hair-plucker body supported in an arcuate position and rotated by a motor within the housing. The hair-plucker body is formed with gaps which open at the convex side and close at the concave side during the rotation of the body in order to catch, pluck and eject hair on the surface over which the body is moved. The hair-plucker body and the housing include quickly-attachable connectors which enable the hair-plucker body to be conveniently removed for cleaning or replacement, or for purposes of enabling each different user to have a personal hair-plucker body.

20 Claims, 1 Drawing Sheet

DEVICE FOR REMOVING HAIR

BACKGROUND OF THE INVENTION

The present invention relates to a depilatory device for removing body hair, such as used for cosmetic purposes. The invention of the present application is particularly applicable to the depilatory device described in U.S. Pat. No. 4,726,375 assigned to the same asignee as the present application, and is therefore described below with respect to this type of device.

U.S. Pat. No. 4,726,375 discloses a depilatory device for removing body hair comprising a manuallygrippable housing, an electric motor within the housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved. The hair-plucker body is coupled to the motor and is supported in an arcuate position such that the gaps open at the convex side of the body during its rotation by the motor to receive the hairs, and close at the concave side of the body to pluck the hairs.

In the embodiment of the invention described in that patent, the hair-plucker body includes a resilient, flexible, cylindrical member of plastic material having a smooth outer surface formed with a plurality of slits penetrating only partially through the plastic cylindrical member and extending circumferentially thereof such that the slits open at the convex side of the plastic cylindrical member and close at the concave side during the rotation of the plastic cylindrical member.

BRIEF SUMMARY OF THE INVENTION

The present invention provides several improvements to the depilatory device of that patent which improvements produce a number of important advantages as will be described more particularly below.

According to one improvement, the housing includes a drive pin of non-circular cross-section coupled to the motor, and a socket spaced from the driven pin. The hair-plucker body includes a collar formed at one side with a stem received in an axial bore in one end of the hair-plucker body, and formed at the opposite side with a bore of the same non-circular cross-section as the drive pin of the housing for coupling thereto in a quickly attachable-detachable manner. The hair-plucker body further includes a bearing pin at the opposite end adapted to be received in the socket of the housing, thereby permitting the hair-plucker body to be quickly attached to or detached from the housing. The socket formed in the housing includes a cylindrical bearing receiving the pin projecting axially from the respective end of the hair-plucker body.

Such an arrangement provides a number of important advantages which are particularly important for hygienic purposes. For example, it was found that in the use of depilatory devices of this type, there is a build-up of body tissue, dirt, and even some blood because plucking a hair sometimes produced a spot of blood at the hair follicle. The above-described arrangement thus not only permits the hair-plucker body to be quickly removed for thorough cleaning or replacement, but also for purposes of enabling each of several different users to have a personal hair-plucker body, which can be color-coded, e.g., by the color of the collar of the hair-plucker body.

According to another aspect of the present invention, there is provided a hair-plucker body for use with a depilatory device, the hair-plucker body comprising a resilient, flexible, cylindrical member of plastic material having a smooth outer surface formed with a plurality of slits penetrating only partially through the plastic cylindrical member and extending circumferentially thereof; a first connector carried at one end of the plastic cylindrical member for attachment to a motor-driven pin in the depilatory device; and a second connector carried at the opposite end of the plastic cylindrical member for coupling to a bearing carried by the depilatory device.

According to a further improvement, the slits in the plastic cylindrical member of the hair-plucker body are arranged in a plurality of groups of four slits per group. Each group of four slits comprising a first pair of parallel slits on one side of the plastic cylindrical member and a second pair of parallel slits aligned with the first pair but on the opposite side of the plastic cylindrical member. Each group of four slits is displaced 90° around the circumference of the plastic cylindrical member with respect to the adjacent group of four slits. Such an arrangement enables the plastic cylindrical member to include a large number of slits while at the same time preserving the mechanical strength of the member.

According to a further feature of the present invention, the device also includes a transparent plate fixed to the housing to overlie one side of the hair-plucker body. This transparent plate forces the user to apply the device at the proper position with respect to the skin so as to catch, pluck and eject the hairs; in addition, it permits the user to view the area being depilated, and also tends to accumulate the plucked hairs on its inner face.

Further, features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
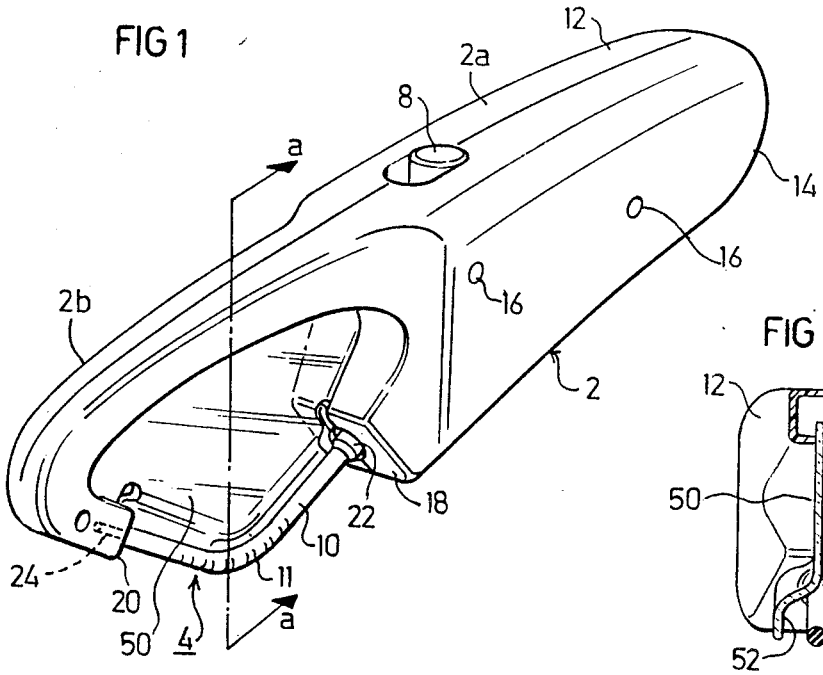
FIG. 1 is a three-dimensional view illustrating one form of depilatory device constructed in accordance with the present invention.
Figure 1A:
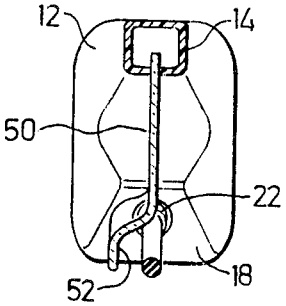
FIG. 1*a* is a sectional view along line a—a of FIG. 1.

The depilatory device illustrated in the drawings is of the type described in the above-referenced U.S. Pat. No. 4,726,375. It includes a manually-grippable housing 2, and a hair-plucker body 4 rotatably mounted to the housing and rotated by an electric motor, schematically shown at 6, within the housing and energized by an electrical switch 8. The rotatable hair-plucker body 4 includes a cylindrical member 10 of a resilient, flexible, plastic material, preferably an elastomer such as natural or synthetic rubber, having a smooth outer surface and formed with a plurality of slits 11 penetrating only partially through the member and extending circumferentially thereof for a part of its circumference. Member 10 is supported in an arc and is rotated about its longitudinal axis by motor 6 such that the slits 11 open at the convex side of the member and close at the concave side during the rotation of the member.

Housing 2 is made of two sections 12, 14, secured together by a plurality of fasteners 16. One end 2*a* of the housing is of generally tear-drop configuration to permit manual gripping by the user, and the opposite end 2*b* of the housing is in the form of an axially-extending stem of generally C-configuration. The opposite faces 18, 20 of the housing stem section 2*b* face each other and are formed with recesses or sockets 22, 24, respectively for receiving the hair-plucker body 4 in a quickly attachable-detachable manner, and are located so as to releasably support the hair-plucker body in the arced condition by the inherent resiliency of the cylindrical plastic member 10.

Figure 2:
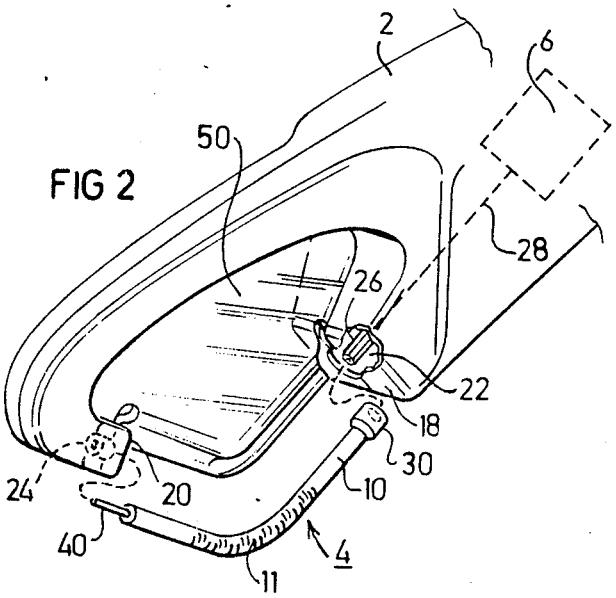
FIG. 2 is a fragmentary view of the device of FIG. 1 and particularly illustrates the quickly attachable-detachable connection between the hair-plucker body and the housing.

As shown particularly in FIG. 2, socket 22 includes a drive member in the form of a pin 26 of non-circular (e.g., hexagonal) configuration coupled by a shaft, schematically shown at 28, to the electric motor 6 within the housing. The respective end of the hair-plucker body 4 carries a connector in the form of a collar 30 having a bore 32 for receiving the drive pin 26, and therefore of the same polygonal configuration (FIG. 3*b*) as the drive pin. Collar 30 is removably attachable to cylindrical member 10 of the hair-plucker body 4 by means of an axially-extending stem 34 received in an axially-extending bore 36 formed in the respective end of member 10.

Socket 24 at the opposite end of housing stem 2*b* includes a bearing, as shown in FIG. 2, which receives an axially-extending pin 40 fixed in the opposite end of member 10.

The foregoing arrangement provides a quickly attachable-detachable connection between the hair-plucker body 4 and the housing 2. Thus, member 10 may be arced manually to align its collar 30 with drive pin 26, and its pin 40 with bearing 24 in order to attach the hair-plucker body 4 to the housing 2, the inherent resiliency of member 2 retaining the hair-plucker body in its arced condition as illustrated in FIGS. 1 and 2. When the hair-plucker body is so attached, collar 30 received on drive pin 26 couples the hair-plucker body so as to be rotated by motor 6, whereas pin 40 received within bearing 24 permits the hair-plucker body to freely rotate between the ends of the housing stem section 2*b* while the hair-plucker body is in its arced condition.

Whenever it is desired to remove the hair-plucker body 4, this may be conveniently done by merely slipping its opposite ends from drive pin 26 and or bearing 24 and then pulling it off, this being permitted by the resilient nature of member 10 of the hair-plucker body.

Housing 2 further includes a transparent plate 50 secured between the two sections 12, 14 of the housing so as to cover one side of the hair-plucker body 4. Transparent plate 50 is formed with a recess 52 along its outer edge of the same arcuate configuration as, and aligned with, the arcuate disposition of the hair-plucker body 4 when attached to the housing.

Figure 3:
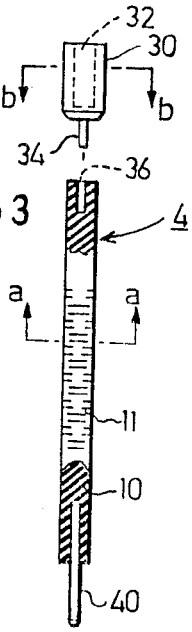
FIG. 3 is a partially-exploded, partially-sectioned view of the hair-plucker body in the device of FIGS. 1 and 2.
Figure 3B:
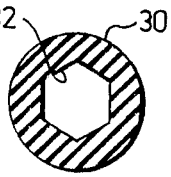
FIGS. 3*a* and 3*b* are sectional views along lines a—a and b—b, respectively, of FIG. 3.
Figure 3A:
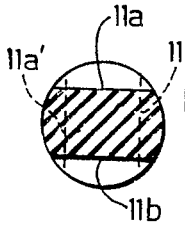

FIGS. 3 and 3*a* more particularly illustrate the pattern of slits 11 formed in the plastic cylindrical member 10. These slits are arranged in groups of four slits per group. This is more particularly illustrated in FIG. 3*a*, wherein it will be seen that one group of four slits includes a first pair of parallel slits 11*a* on one side of the plastic cylindrical member 10, and a second pair of parallel slits 11*b* aligned with the first pair but on the opposite side of the plastic cylindrical member. FIG. 3*a*, illustrates only one slit of each pair 11*a* and 11*b*, wherein it will be seen that each slit extends for less than one-half the circumference of the plastic cylindrical member 10. It will be appreciated that the other slit of the pair is parallel to the illustrated slit 11*a*, 11*b* but spaced axially therefrom, as more particularly seen in FIG. 3.

Each group of four slits is displaced or staggered 90° around the circumference of the plastic cylindrical member 10 with respect to the adjacent group of four slits. This is also seen in FIG. 3*a*, wherein the group of four slits adjacent to slits 11*a*, 11*b*, shown in broken lines and identified as 11*a*′ and 11*b*′, are rotated 90° with respect to the group of slits 11*a*, 11*b*.

It has been found that such an arrangement enables the plastic cylindrical member 10 to include a large number of slits which open substantially, during the rotation of the member, in order to catch and pluck a large number of hairs, while at the same time preserving the mechanical strength of the member.

The manner of using the depilatory device illustrated in the drawings will be apparent from the above description. Thus, the hair-plucker body 4 may be conveniently applied to housing 2 by inserting collar 30 of the hair-plucker body into drive pin 26 of the housing, and by inserting pin 40 of the hair-plucker body into bearing 24 of the housing. The resilient nature of the plastic cylindrical member 10 of the hair-plucker body 4 permits this to be done in a very quick and facile manner. When the hair-plucker body is so attached, it is supported and retained in its arced condition by the inherent resiliency of the plastic cylindrical member 10, so that its rotation by motor 6 causes the slits 11 formed in member 10 to open at the convex side of the member, and to close at its concave side, thereby catching, plucking, and ejecting hairs as the hair-plucker body 4 is moved over the user's skin.

The quickly attachable-detachable connection of the hair-plucker body 4 to the housing 2 enables the hair-plucker body to be removed, cleaned and/or replaced in a very convenient manner. This arrangement also permits several persons to use the same device by merely attaching their personal hair-plucker body to the device. For this purpose, collar 30 may be made available in several colors in order to identify the personal hair-plucker body of the individual user.

The transparent plate 50 is fixed to the housing 2 to overlie one side of the hair-plucker body 4, which forces the user to apply the device at the proper position with respect to the skin so as to catch, pluck and eject the hairs. The transparent plate 50 also permits the user to view the area being depilated, and further, it tends to accumulate the plucked hairs on its inner surface, which may be periodically cleaned, e.g., by blowing or brushing.

While the invention has been described with respect to one preferred embodiment, it will be appreciated that many other variations, modifications and applications of the invention may be made.

What is claimed is:

1. A depilatory device for removing body hair, comprising: a manually-grippable housing, an electric motor within the housing, and a hair-plucker body rotatably mounted to the housing and having an exposed section formed with a plurality of gaps in its outer surface which during the rotation of the hair-plucker body receive, pluck, and eject body hair growing on a surface over which the hair-plucker body is moved; said hair-plucker body being coupled to said motor and being supported in an arcuate position such that the gaps are open at the convex side of the body during its rotation by the motor to receive the hairs and are closed at the concave side of the body to pluck the hairs; characterized in that the outer face of said housing includes a drive pin of non-circular cross-section coupled to said motor, and a socket spaced from said drive-pin; said hair-plucker body including a collar formed at one side with a stem received in an axial bore in one end of the hair-plucker body, and formed at the opposite side with a bore of the same non-circular cross-section as said drive pin of the housing for coupling thereto in a quickly attachable-detachable manner, said hair-hair-plucker body including a bearing pin at the opposite end adapted to be received in said socket, thereby permitting said hair-plucker body to be quickly attached to or detached from said housing.

2. The device according to claim 1, wherein said drive pin is disposed in a recess in said housing.

3. The device according to claim 1, wherein said housing includes a stem extending axially of the housing, said socket being formed in said housing stem and including a cylindrical bearing receiving said bearing pin at said opposite end of the hair-plucker body.

4. The device according to claim 1, wherein said hair-plucker body includes a resilient, flexible, cylindrical member of plastic material having a smooth outer surface formed with a plurality of slits penetrating only partially through the plastic cylindrical member and extending circumferentially thereof such that said slits constitute said gaps which open at the convex side of the plastic cylindrical member and close at the concave side during the rotation of the plastic cylindrical member.

5. The device according to claim 4, wherein said slits in the plastic cylindrical member are arranged in a plurality of groups of four slits per group; each group of four slits comprising a first pair of parallel slits on one side of the plastic cylindrical member and a second pair of parallel slits aligned with the first pair but on the opposite side of the plastic cylindrical member; each group of four slits being displaced 90° around the circumference of the plastic cylindrical member with respect to the adjacent group of four slits.

6. A depilatory device for removing body hair, comprising: a manually-grippable housing, an electric motor within the housing, and a hair-plucker body rotatably mounted to the housing and having an exposed section formed with a plurality of gaps in its outer surface which, during the rotation of the hair-plucker body, receive, pluck and eject body hair growing on a surface over which the hair-plucker body is moved; said hair-plucker body being coupled to said motor and being supported in an arcuate position such that the gaps are open at the convex side of the body during its rotation by the motor to receive the hairs and are closed at the concave side of the body to pluck the hairs; and a transparent plate fixed to the housing to overlie one side of the hair-plucker body.

7. The device according to claim 6, wherein said housing is made of two sections secured together, said transparent plate being secured between said two sections of the housing and being formed with a recess extending along one edge, said recess having an arcuate configuration which is the same as, and which is aligned with, said arcuate position of the hair-plucker body.

8. The depilatory device according to claim 6, wherein said device further includes first and second sockets formed in said housing said first socket including a connector member coupled to said motor so as to be rotated thereby, and said second socket including a bearing;

said first and second sockets having open ends located so as to support the hair-plucker body therebetween in an arced condition;

one end of said hair-plucker body including a connector member receivable in a quickly attachable-detachable manner in said first socket so as to be connected to said connector member therein and to be rotated by the motor within the housing;

the opposite end of said hair-plucker body including a connector member receivable in a quickly attachable-detachable manner in the bearing of the second socket so as to be rotatable therein, such that the hair-plucker body is quickly attachable to the housing by inserting its opposite ends into the first and second sockets formed in the housing, and is rotated, while retained in an arced condition in said first and second sockets, by the motor within the housing to cause the gaps at the convex side of the hair-plucker body to open and the gaps at the concave side to close during the rotation of the hair-plucker body.

9. The device according to claim 8, wherein said connector member in said first socket is a drive pin of polygonal configuration, and said connector member at said one end of the hair-plucker body is a collar formed with a bore of corresponding polygonal configuration for receiving said drive pin in said first socket.

10. The device according to claim 9, wherein said collar is formed with a stem removably received in an axially-extending bore formed in said one end of the hair-plucker body.

11. The device according to claim 6, wherein said hair-plucker body includes a resilient, flexible, cylindrical member of plastic material having a smooth outer surface formed with a plurality of slits penetrating only partially through the plastic cylindrical member and extending circumferentially thereof such that said slits constitute said gaps which open at the convex side of the plastic cylindrical member and close at the concave side during the rotation of the plastic cylindrical member.

12. The depilatory device according to claim 11, wherein said slits in the plastic cylindrical member are arranged in a plurality of groups of four slits per group; each group of four slits comprising a first pair of parallel slits on one side of the plastic cylindrical member and a second pair of parallel slits aligned with the first pair but on the opposite side of the plastic cylindrical member; each group of four slits being displaced 90° around the circumference of the plastic cylindrical member with respect to the adjacent group of four slits.

13. A hair-plucker body for use with a depilatory device, said hair-plucker body comprising a resilient, flexible, cylindrical member of plastic material having a smooth outer surface formed with a plurality of slits penetrating only partially through the plastic cylindrical member and extending circumferentially thereof; a first connector carried at one end of said plastic cylindrical member for attachment to a motor-driven pin in the depilatory device; and a second connector carried at the opposite end of said plastic cylindrical member for coupling to a bearing carried by the depilatory device; said first connector carried at said one end of the plastic cylindrical member being a collar formed at one side with a bore of non-circular configuration for receiving a correspondingly configured motor-driven pin in the depilatory device; said collar being formed at its opposite side with an axially-extending stem received in an axially-extending bore formed in said one end of the plastic cylindrical member.

14. The hair-plucker body according to claim 13, wherein said connector at said opposite end of the plastic cylindrical member is a pin projecting axially thereof and received in a bearing in the depilatory device.

15. The hair-plucker body according to claim 13, wherein said slits in the plastic cylindrical member are arranged in a plurality of groups of four slits per group; each group of four slits comprising a first pair of parallel slits on one side of the plastic cylindrical member and a second pair of parallel slits aligned with the first pair but on the opposite side of the plastic cylindrical member; each group of four slits being displaced 90° around the circumference of the plastic cylindrical member with respect to the adjacent group of four slits.

16. A hair-plucker body for use with a depilatory device, said hair-plucker body comprising a resilient, flexible, cylindrical member of plastic material having a smooth outer surface formed with a plurality of slits penetrating only partially through the plastic cylindrical member and extending circumferentially thereof; said slits in the plastic cylindrical member being arranged in a plurality of groups of four slits per group; each group of four slits comprising a first pair of parallel slits on one side of the plastic cylindrical member and a second pair of parallel slits aligned with the first pair but on the opposite side of the plastic cylindrical member; each group of four slits being displaced 90° around the circumference of the plastic cylindrical member with respect to the adjacent group of four slits.

17. The hair-plucker body according to claim 16, further including a first connector carried at one end of said plastic cylindrical member for attachment to a motor-driven pin in the depilatory device; and a second connector carried at the opposite end of said plastic cylindrical member for coupling to a bearing carried by the depilatory device.

18. The hair-plucker body according to claim 17, wherein said first connector carried at said one end of the plastic cylindrical member is a collar formed at one side with a bore of non-circular configuration for receiving a correspondingly configured motor-driven pin in the depilatory device.

19. The hair-plucker body according to claim 18, wherein said collar is formed at the opposite side with an axially-extending stem received in an axially-extending bore formed in said one end of the plastic cylindrical member.

20. The hair-plucker body according to claim 17, wherein said connector carried at said opposite end of the plastic cylindrical member is a pin projecting axially thereof and received in a bearing in the depilatory device.

* * * * *